US007244132B1

(12) United States Patent
Cairns et al.

(10) Patent No.: US 7,244,132 B1
(45) Date of Patent: Jul. 17, 2007

(54) CONNECTOR INCLUDING INTERLOCKING ASSEMBLY AND ASSOCIATED METHODS

(75) Inventors: James L. Cairns, Ormond Beach, FL (US); Stewart M. Barlow, Ormond Beach, FL (US)

(73) Assignee: Ocean Design, Inc., Daytona Beach, FL (US)

( * ) Notice: Subject to any disclaimer, the term of this patent is extended or adjusted under 35 U.S.C. 154(b) by 0 days.

(21) Appl. No.: 11/279,486

(22) Filed: Apr. 12, 2006

(51) Int. Cl.
*H01R 4/60* (2006.01)

(52) U.S. Cl. ..... 439/191; 439/201

(58) Field of Classification Search ..... 439/191, 439/201, 278, 281
See application file for complete search history.

(56) References Cited

U.S. PATENT DOCUMENTS

| | | | | |
|---|---|---|---|---|
| 4,666,242 | A | 5/1987 | Cairns | |
| 4,948,377 | A | 8/1990 | Cairns | |
| 5,162,617 | A | 11/1992 | Ferbas | |
| 5,194,012 | A | 3/1993 | Cairns | |
| 5,203,805 | A | 4/1993 | Cairns | |
| 5,645,438 | A | 7/1997 | Cairns | |
| 5,645,442 | A | 7/1997 | Cairns | |
| 5,722,842 | A | 3/1998 | Cairns | |
| 5,772,457 | A | 6/1998 | Cairns | |
| 5,873,750 | A | 2/1999 | Cairns | |
| 6,017,227 | A | 1/2000 | Cairns | |
| 6,067,395 | A | 5/2000 | Cairns | |
| 6,315,461 | B1 | 11/2001 | Cairns | |
| 6,321,021 | B1 | 11/2001 | Cairns | |
| 6,332,787 | B1 | 12/2001 | Barlow | |
| 6,464,405 | B2 | 10/2002 | Cairns | |
| 6,511,335 | B1 * | 1/2003 | Rayssiguier et al. | 439/191 |
| 6,736,545 | B2 | 5/2004 | Cairns | |
| 6,780,037 | B1 * | 8/2004 | Parmeter et al. | 439/191 |
| 6,796,821 | B2 | 9/2004 | Cairns | |
| 6,910,910 | B2 | 6/2005 | Cairns | |

* cited by examiner

*Primary Examiner*—Tho D. Ta
(74) *Attorney, Agent, or Firm*—Propopio, Cory, Hargreaves & Savitch

(57) ABSTRACT

A connector may include first and second connector portions movable between unmated and mated positions; first and second bladders carried by respective connector portions, and each having an end movable between a closed position and an open position; and an interlocking assembly including first and second portions carried by respective connector portions and being movable between a released position, permitting opposing ends of the bladders to move apart, and an interlocked position, holding the opposing ends of the bladders together. The interlocking assembly may hold the opposing ends of the bladders together as the opposing ends of the bladders move from the closed position to the open position and/or as the opposing ends of the bladders move from the open position to the closed position. Also, the interlocking assembly may provide a positive drawback between its first and second portions during movement from the interlocked position to the released position.

48 Claims, 7 Drawing Sheets

CONNECTOR INCLUDING INTERLOCKING ASSEMBLY AND ASSOCIATED METHODS

FIELD OF THE INVENTION

The invention relates to the field of connectors, and, more particularly, to electrical and/or optical connectors and related methods.

BACKGROUND OF THE INVENTION

Underwater cables are commonly used to carry electrical power and/or signals. There is a need to make connections between adjacent cable ends, or between a cable end and associated equipment, for example. Accordingly, there are also submersible cable connectors for such hostile or underwater, high pressure environments. Such cable connectors not only have to operate under extreme conditions, but for some applications they may need to be mateable while submerged, that is, wet-mateable. A submersible robotic device may also be used to mate and demate the wet-mateable cable connector portions.

The assignee of the present invention, Ocean Design, Inc. of Daytona Beach, Fla., has developed various significant improvements in wet-mateable connectors as disclosed in U.S. Pat. Nos. 4,948,377; 5,162,617; 5,194,012; 5,203,805; 5,645,438; 5,645,442; 5,772,457; 5,722,842; 5,873,750; 6,017,227; 6,067,395; 6,315,461; 6,332,787; 6,464,405; 6,736,545; 6,796,821; and 6,910,910, for example. The entire content of each of these patents is incorporated herein by reference.

One line of wet-mateable connectors is of the type as described in U.S. Pat. No. 6,736,545, for example. The patent discloses a wet-mateable connector comprising first and second connector portions being movable between unmated and mated positions. In addition, the connector also includes first and second bladders in respective connector portions and cooperating therewith so that opposing ends of the bladders are sealably urged together and moved from a closed to an open position as the connector portions are moved from the unmated to the mated position.

More particularly, the first connector portion includes a first tubular shell including interior portions defining a fixed oval constriction. The second connector portion comprises a second tubular shell and an actuator slidable therein and defining a slidable oval constriction. The second bladder is extended longitudinally beyond the slidable and fixed oval constrictions and into the interior of the first shell when the connector portions are moved to the mated position. This mating action causes the ends of the bladders to move to the open position, yet provides a seal therebetween to surrounding water, to permit engagement of contacts. Conversely, the bladders are closed to seal the respective contacts from the surrounding water when the connector is moved to the unmated position. Commercial versions of this wet-mateable connector are offered from Ocean Design, Inc. of Daytona Beach, Fla. under the designation I-CONN.

One disadvantage of the type of wet-mateable connector as disclosed in U.S. Pat. No. 6,736,545 is that the manufacturing of the tapered, oval-shaped, fixed or sliding constriction is relatively complicated. Another disadvantage is that the shape of the opening in the ends of the bladders may not be large enough when open to use higher fiber counts, for example. Yet another shortcoming of the connector is that a spring applying a relatively high spring force is used to urge the ends of the bladders together as the connector portions are moved from the unmated to the mated positions. One other spring also serves to return the slidable oval throat to its fully outward position when the connector portions are moved to the unmated position. As the spring is compressed during mating, its resistive force increases and this may result in undesirably high mating forces. The connector relies entirely upon the springs to return the components to their unmated positions. Accordingly, it may also happen that debris such as sand cannot be overcome by the springs, and they could fail to return the components to their desired unmated positions.

SUMMARY OF THE INVENTION

In view of the foregoing background, it is therefore an object of the invention to provide a connector that is readily manufactured and facilitates installation, such as particularly, but not exclusively, for submersible applications.

This and other objects, features, and advantages in accordance with the invention are provided by a connector comprising first and second connector portions movable between unmated and mated positions; first and second bladders carried by respective connector portions, and each having an end movable between a closed position and an open position; and an interlocking assembly comprising first and second portions carried by respective connector portions and being movable between a released position, permitting opposing ends of the bladders to move apart, and an interlocked position, holding the opposing ends of the bladders together. More particularly, in some embodiments the interlocking assembly may hold the opposing ends of the bladders together as the opposing ends of the bladders move from the closed position to the open position. Alternatively or additionally, the interlocking assembly may hold the opposing ends of the bladders together as the opposing ends of the bladders move from the open position to the closed position. Also alternatively or additionally, the interlocking assembly may provide a positive drawback between its first and second portions during movement from the interlocked position to the released position. The interlocking assembly may be moved to the interlocked position as the connector portions are moved from the unmated to the mated position, and may be moved to the released position as the connector portions are moved from the mated to the unmated position.

The interlocking assembly may hold the opposing ends of the bladder together with a substantially constant force when in the interlocked position. The interlocking assembly may comprise an initial arrestor for initially arresting movement of one of the bladders during initial engagement with an opposing end of the other of the bladders as the first and second connector portions are moved from the unmated position to the mated position. In addition, the first and second portions of the interlocking assembly may comprise at least one first tine and at least one second tine selectively interlocking with the at least one first tine. The interlocking assembly may eliminate the strong springs of the prior art connectors, may ensure positive drawback not provided in the prior art connectors, and may ensure that the face-to-face sealing force remains adequate during demating which was not positively provided in prior art connectors which instead had a decreasing force to the point where the faces actually separated if friction made spring-induced throat return difficult. The connector may also enjoy a predetermined and constant face-to-face force of the seals at all times which was also not provided in the prior art.

The initial arrestor may comprise a detent mechanism coupled between the first connector portion and the at least one first tine to operate (release) at a predetermined point along a path of travel as the first and second connector portions are moved from the unmated position to the mated position. The initial arrestor may also comprise a spring operatively coupled between the first bladder and the detent mechanism for providing a desired sealing force to the opposing ends of the first and second bladders.

At least one of the first and second connector portions may comprise a release feature for moving the at least one pair of first and second tines from the interlocked to the released position as the first and second connector portions are moved from the mated position to the unmated position.

The first and second connector portions may cooperate with the first and second bladders to urge the opposing ends thereof together and to move the opposing ends from the closed position to the open position as the first and second connector portions are moved from the unmated position to the mated position. For example, the first connector portion may include a first tubular shell including interior portions defining a fixed frustoconical constriction. The second connector portion may comprise a second tubular shell and an actuator slidable therein and defining a slidable frustoconical constriction. The second bladder may extend longitudinally beyond the slidable and fixed frustoconical constrictions and into the interior of the first shell when the first and second connector portions are in the mated position so that the first and second bladders are in the open position.

Each of the first and second connector portions may comprise a base, a tubular shell extending outwardly from the base, and at least one mateable contact carried by the base within a respective bladder. For example, the at least one mateable contact may be electrical and/or optical.

Method aspects of the invention are for making the various connector embodiments. The method may include forming first and second connector portions movable between unmated and mated positions and carrying respective first and second bladders having ends movable between a closed position and an open position, and forming an interlocking assembly as described above.

DETAILED DESCRIPTION OF THE PREFERRED EMBODIMENTS

The invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Referring initially to FIGS. 1–5, a connector 10, such as for submersible applications, and in accordance with the invention is now described. The connector 10 comprises first and second connector portions 12*a*, 12*b* being movable between unmated (FIG. 1) and mated positions (FIG. 2) as will be appreciated by those of skill in the art. First and second bladders 14*a*, 14*b* are contained in respective first and second connector portions 12*a*, 12*b* and cooperate therewith so that opposing ends 16*a*, 16*b* of the first and second bladders are urged sealably together and moved from a closed position (FIG. 4) to an open position (FIG. 5) as the first and second connector portions are moved from the unmated to the mated position, for example. The opposing ends 16*a*, 16*b* of the bladders 14*a*, 14*b* may move from the closed position to the open position based upon the shape memory of the bladder material, and as the ends move from their respective constrictions explained in greater detail below.

Conversely, when the connector portions 12*a*, 12*b* are moved to the unmated position, the bladders 14*a*, 14*b* move from the opened to the closed position. The ends 16*a*, 16*b* of the bladders 14*a*, 14*b* remain sealably urged together until the operation is complete. One or both of the bladders 14*a*, 14*b* may have a unitary structure or may be formed of multiple components as will be appreciated by those skilled in the art.

In the illustrated embodiment, each of the first and second connector portions 12*a*, 12*b* defines a circular constriction 18*a*, 18*b* for closing an end 16*a*, 16*b* of a respective bladder 14*a*, 14*b* into a circular peripheral shape (FIG. 4) when the first and second connector portions are in the unmated position. Accordingly, the connector 10 may be more easy to manufacture, and may still perform well in harsh environments.

Figure 1:
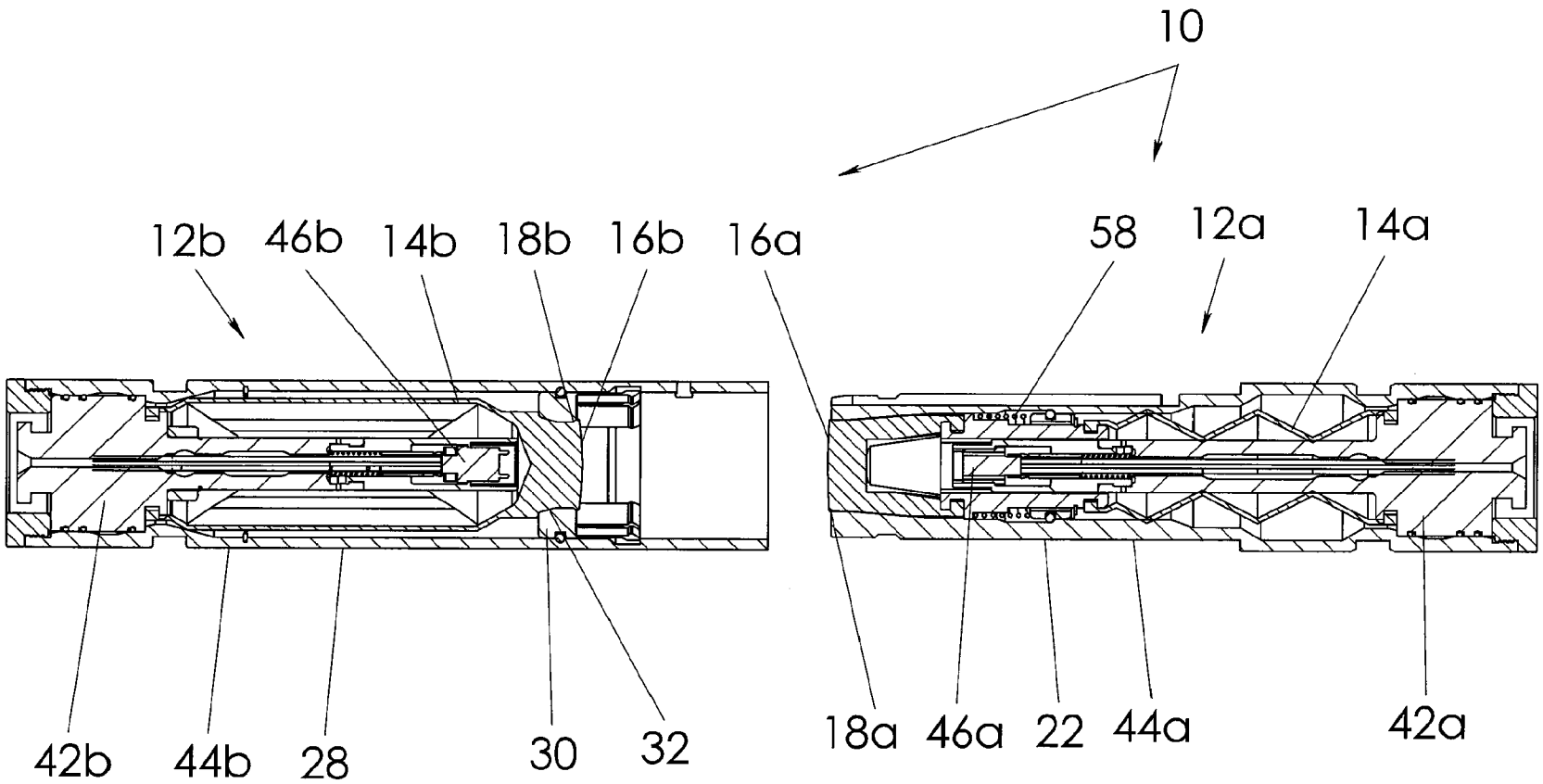
FIG. 1 is a longitudinal cross-sectional view of a connector in accordance with the invention shown in the unmated position.
Figure 2:
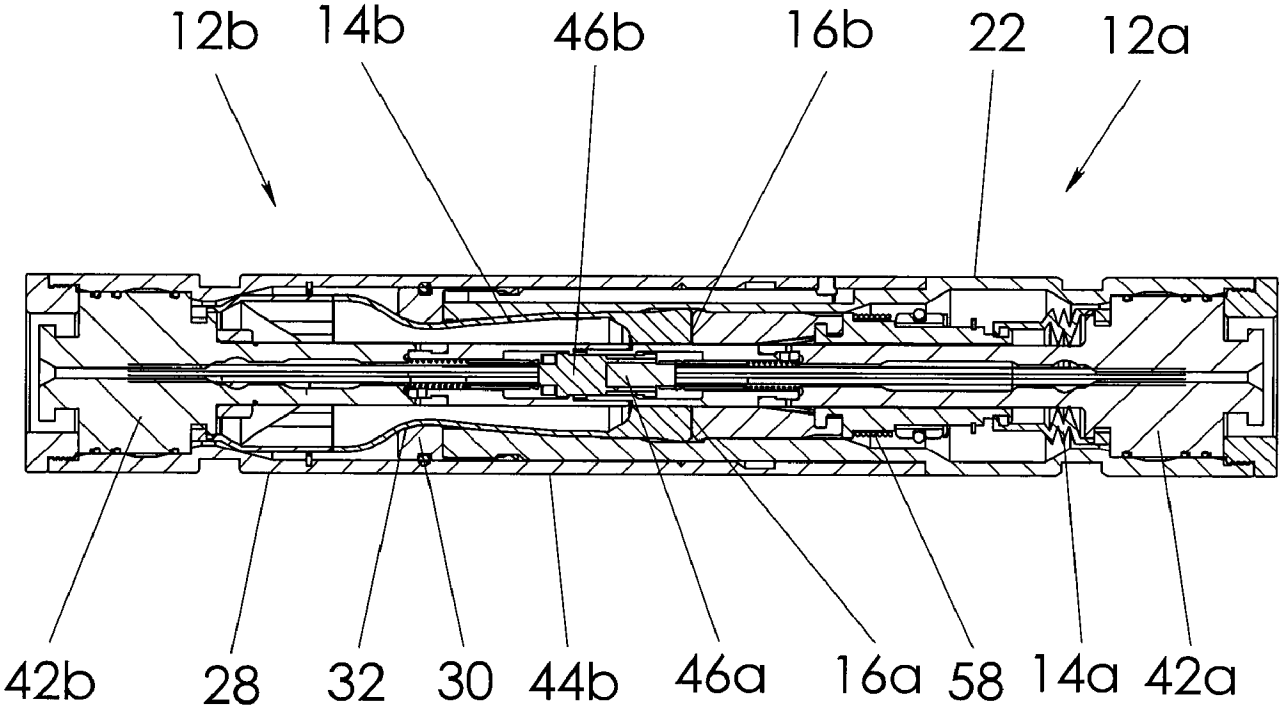
FIG. 2 is a longitudinal cross-sectional view of the connector of FIG. 1 shown in the mated position.
Figure 3:
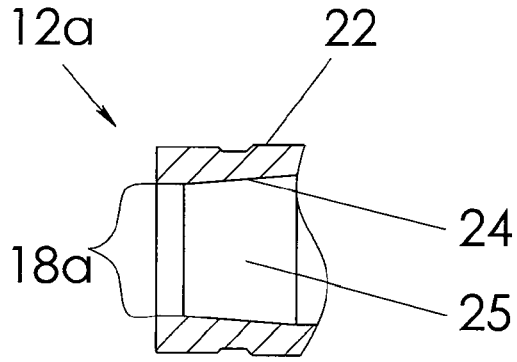
FIG. 3 is an enlarged longitudinal cross-sectional view of a portion of the fixed frustoconical constriction of the connector of FIG. 1.
Figure 4:
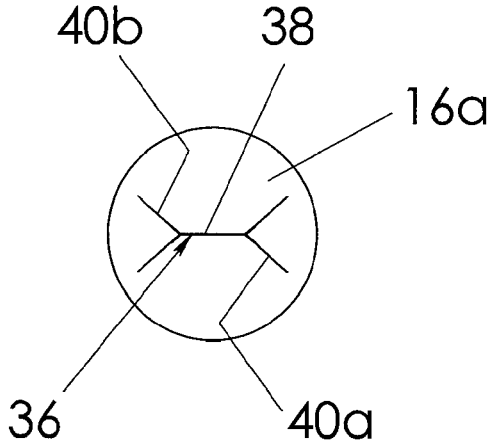
FIG. 4 is an end view of a bladder of the connector of FIG. 1 illustrating the bladder in a closed position.

The first connector portion 12*a* comprises a first tubular shell 22 including interior portions defining a fixed frustoconical constriction 24 terminating in the first circular constriction 18*a* as shown perhaps best in FIG. 3. The second connector portion 12*b* illustratively includes a second tubular shell 28 and an actuator 30 slidable therein and defining a slidable frustoconical constriction 32 terminating in second circular constriction 18*b*. As shown perhaps best in FIG. 2, the second bladder 14*b* extends longitudinally beyond the slidable frustoconical constriction 32 and fixed frustoconical constriction 24 and into the interior of the first shell 22 when the first and second connector portions 12*a*, 12*b* are in the mated position. In this mated position, the ends 16*a*, 16*b* of the first and second bladders 14*a*, 14*b* are in the open position.

Figure 5:
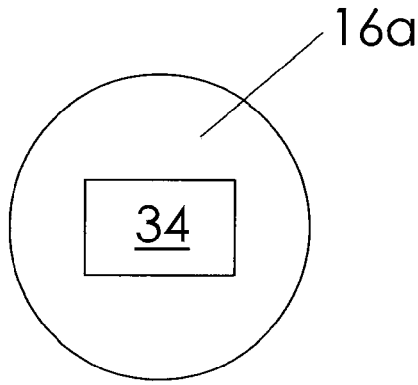
FIG. 5 is an end view of a bladder as shown in FIG. 4 but illustrating the bladder in an open position.
Figure 6:
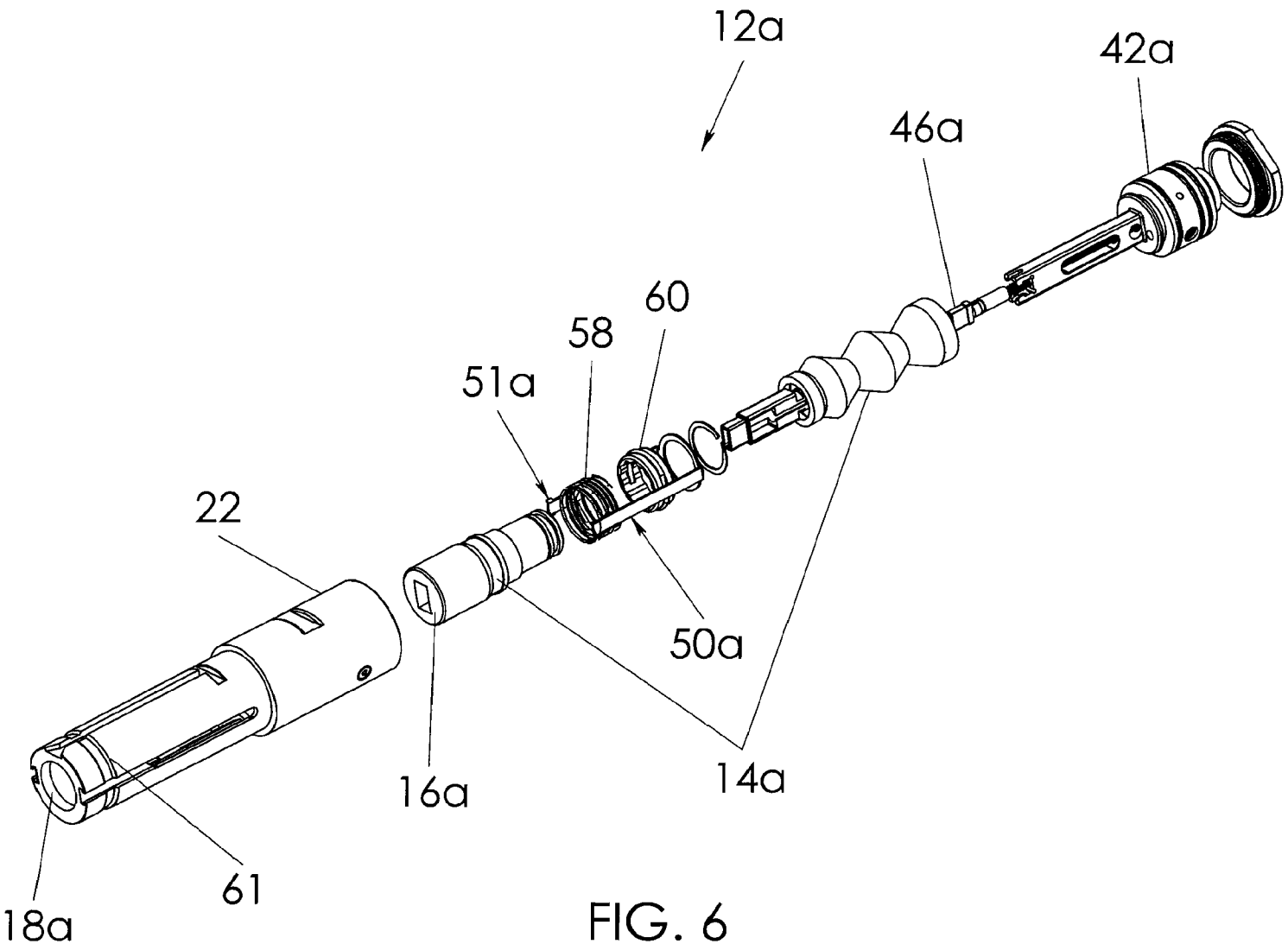
FIG. 6 is a perspective, exploded view of the parts of the first connector portion of the connector of FIG. 1.
Figure 7:
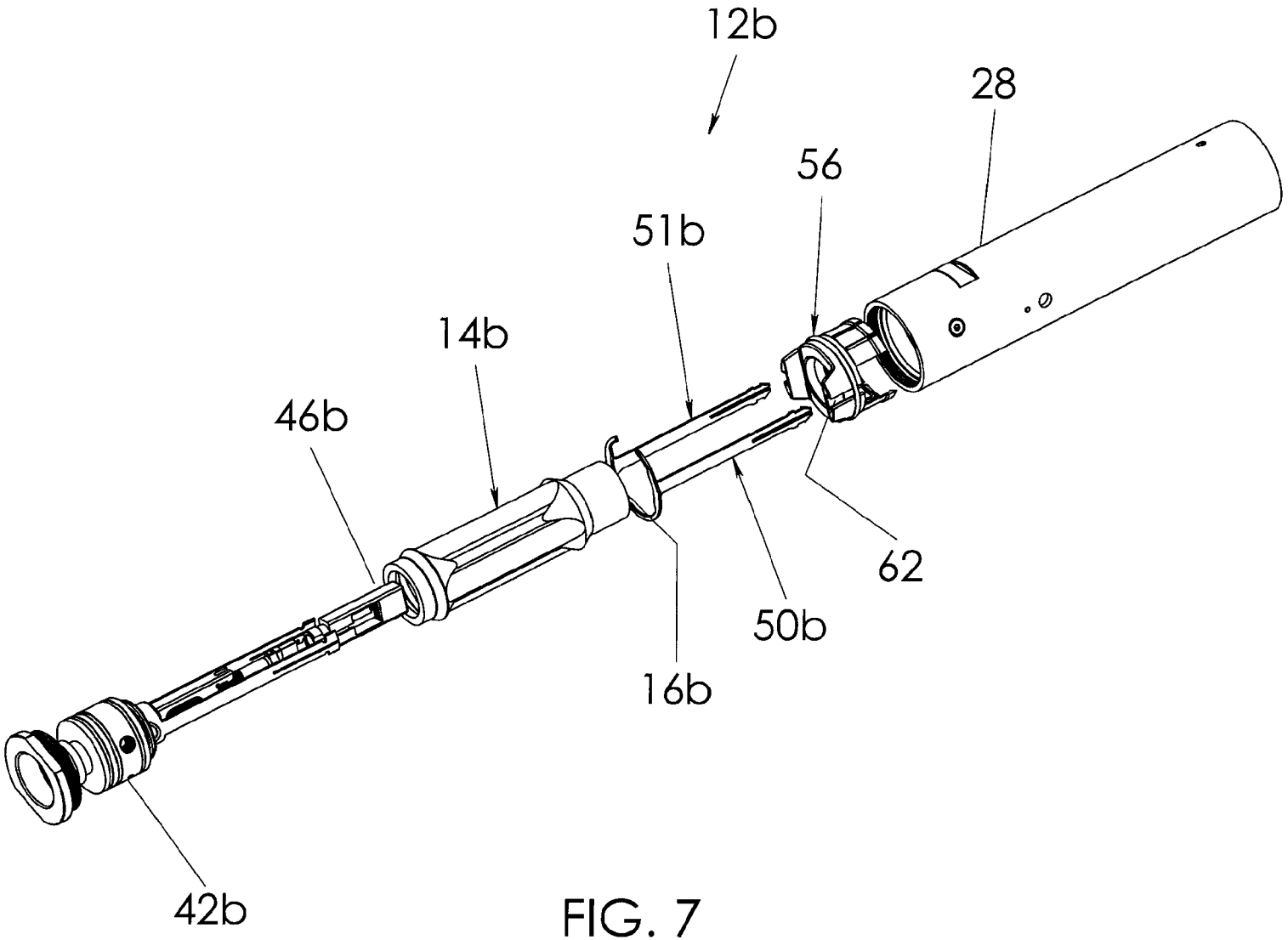
FIG. 7 is a side perspective, exploded view of the parts of the second connector portion of the connector of FIG. 1.

In the illustrated embodiment, each of the opposing ends 16*a*, 16*b* of the first and second bladders 14*a*, 14*b* defines a generally rectangular aperture when in the open position, such as the aperture 34 for the first bladder 16*a* shown in FIG. 5, for example. One, and preferably, both of the opposing ends 16*a*, 16*b* of the first and second bladders 14*a*, 14*b* define a series of closed slits when in the closed position, such as shown by reference number 36 in FIG. 4.

The pattern of slits 36 is formed as the generally rectangular aperture 34 is squeezed by passage through the respective constriction as will be appreciated by those of skill in the art. The series of closed slits 36 illustratively comprises a medial closed slit 38 and a pair of diverging V-shaped closed slits 40*a*, 40*b* extending from opposite ends of the medial closed slit. Of course, other arrangements of slits are also contemplated as will be appreciated by those skilled in the art. The slits 36 and generally rectangular aperture 34 cooperate to provide an enlarged aperture through which more, and/or larger contacts, and/or generally rectangular contacts may pass when in the mated position, while still providing a tight environmental seal when in the unmated position, and during mating and unmating.

Continuing with the description of the basic components of the connector 10, each of the first and second connector portions 12*a*, 12*b* may comprise a respective base 42*a*, 42*b*, a tubular shell 44*a*, 44*b* extending outwardly from the base, and a mateable electrical and/or optical contact or contacts 46*a*, 46*b* carried by the base within a respective bladder 14*a*, 14*b*. Of course, the connector 10 may include both electrical and optical contacts in a hybrid arrangement. The connector 10 may further comprise a dielectric material 25, such as a dielectric oil, for example, contained within each of the first and second bladders 14*a*, 14*b*. The dielectric material fills the space in each bladder and prevents distortion or crushing that would otherwise occur when submerged due to the increased pressure as will be appreciated by those skilled in the art.

Those of skill in the art will also appreciate that the circular constriction feature of the connector 10 may be advantageously used in combination with the bladder generally rectangular aperture shape. In other embodiments, these features may be used independent of one another and still provide important advantages over prior art connectors. For example, the circular constriction may be used with bladder aperture shapes different from the generally rectangular shape. Conversely, the rectangular bladder aperture shape can be used with constrictions having shapes other than circular.

Referring now additionally to FIGS. 6–9, further advantageous aspects of the connector 10 are now described. As an introduction, the connector 10 may include an interlocking assembly comprising first and second portions carried by respective connector portions 12*a*, 12*b* and being movable between a released position permitting the opposing ends 16*a*, 16*b* of the bladders 14*a*, 14*b* to move apart, and an interlocked position holding the opposing ends of the bladders together. In some advantageous embodiments, the interlocking assembly may hold the opposing ends 16*a*, 16*b* of the bladders 14*a*, 14*b* together with a substantially constant force as the opposing ends of the bladders move from the closed position to the open position. Alternatively or additionally, the interlocking assembly may hold the opposing ends 16*a*, 16*b* of the bladders 14*a*, 14*b* together with a substantially constant force as the opposing ends of the bladders move from the open position to the closed position.

Alternatively or additionally, the interlocking assembly of the connector 10 may provide a positive drawback between its first and second portions during movement from the interlocked position to the released position. The interlocking assembly may be moved to the interlocked position as the connector portions 12*a*, 12*b* are moved from the unmated to the mated position, and may be moved to the released position as the connector portions are moved from the mated to the unmated position.

The connector 10 illustratively comprises an interlocking assembly in the form of left and right, or two pairs of first and second interlocking tines 50*a*, 50*b*; 51*a*, 51*b* carried by respective first and second connector portions 12*a*, 12*b* on opposite sides of the connector. In other embodiments, a single tine or multiple tines may be used on only one of the connector portions as will be appreciated by those skilled in the art. The other connector portion may include one or more catches that cooperate with the tines, for example.

The interlocking assembly of the connector 10 may also comprise an initial arrestor for initially arresting movement of one of the bladders during initial engagement with an opposing end of the other of the bladders as the first and second connector portions 12*a*, 12*b* are moved from the unmated position to the mated position. In the illustrated embodiment, the initial arrestor is provided by a detent mechanism including the O-ring 60 carried within the first shell 22 and cooperating with a corresponding releasable engagement recess 61 on a medial internal surface of the first shell. The detent mechanism operates (disengages) at a predetermined point along a path of travel as the first and second connector portions 12*a*, 12*b* are moved from the unmated position to the mated position as will be appreciated by those of skill in the art. Those of skill in the art will appreciate other equivalent mechanisms may also provide the initial arrestor.

The connector 10 further comprises a spring 58 operatively connected between the end 16*a* of the first bladder 14*a* and the ring 60 of the detent mechanism for providing a desired sealing force to the opposing ends 16*a*, 16*b* of the first and second bladders 14*a*, 14*b*. Once the tines 50*a*, 50*b*; 51*a*, 51*b* are brought together and interlocked, the detent mechanism can release while the spring 58 still provides the needed sealing force between the bladder ends. This arrangement, in combination with the operation of the tines 50*a*, 50*b*; 51*a*, 51*b*, permits a smaller spring to be used thereby making mating less awkward, while still providing an adequate sealing force. Now it is the tines 50*a*, 50*b*; 51*a*, 51*b* that return the components to their original positions when unmating, and not the large springs required in the prior art connectors. There are several main advantages achieved. One is that debris cannot overcome the limited spring force previously available to return the components to their unmated positions. Second, the face-to-face force on the opposed bladder ends may be constant, pre-selected and controlled over the entire mate/unmate cycle. In other words, the connector 10 may have a minimal mating force and need not rely entirely on springs to return the moveable components from their mated to unmated positions.

Figure 8:
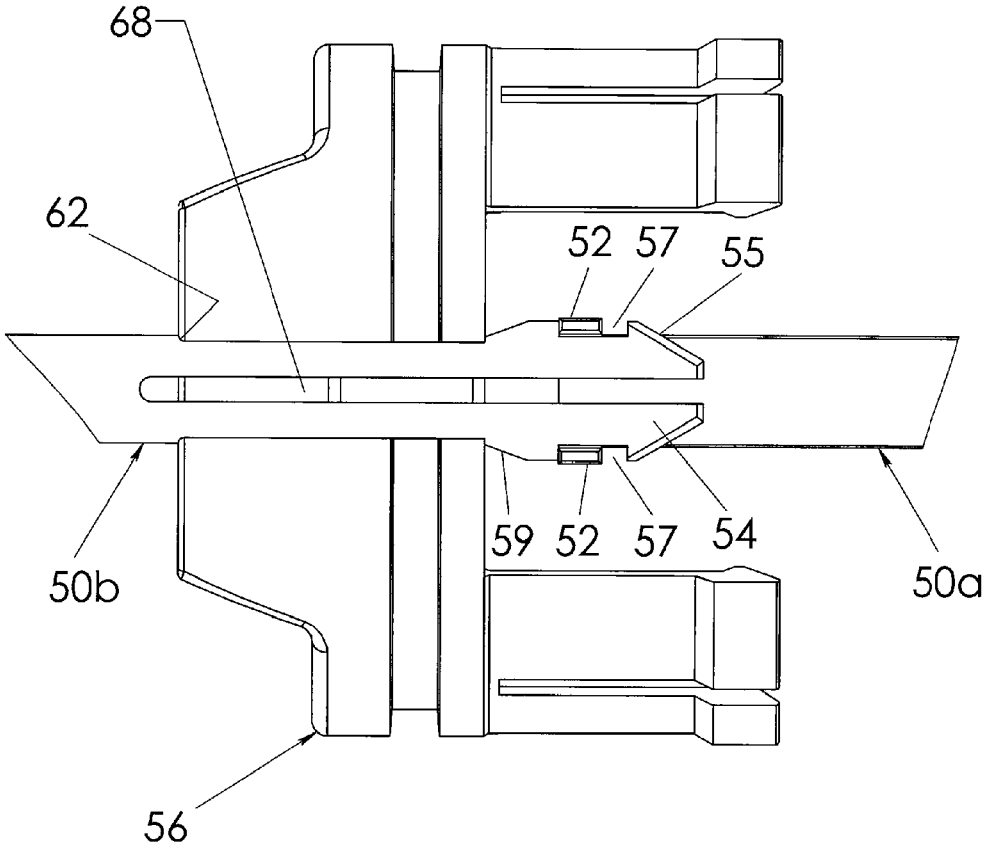
FIG. 8 is a side elevational view of a portion of the tines of FIGS. 6 and 7 in the interlocked position.
Figure 9:
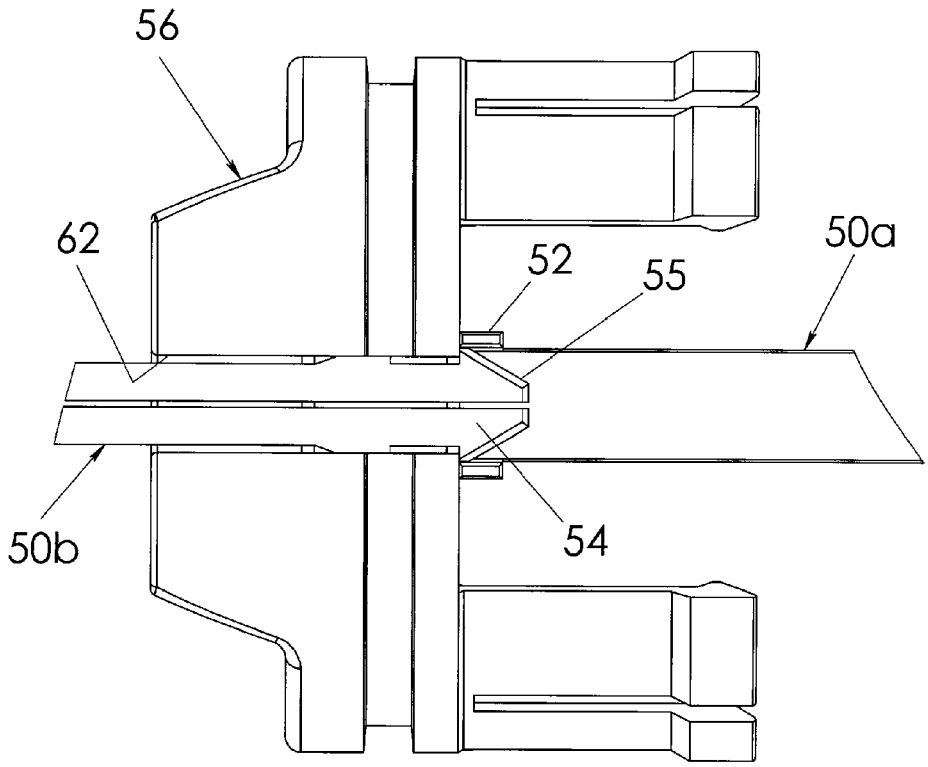
FIG. 9 is a side elevational view of a portion of the tines of FIGS. 6 and 7 illustrated as moving to the released position.

When the connector portions 12*a*, 12*b* are moved from the mated to unmated position, the tines 50*a*, 50*b*; 51*a*, 51*b* move from the interlocked position (FIG. 8) that holds the opposing ends 16*a*, 16*b* of the first and second bladders 14*a*, 14*b* together, to the released position (FIG. 9) that permits the opposing ends of the first and second bladders to move apart, as described in greater detail below Only one pair of the interlocking tines 50*a*, 50*b* is illustrated in FIGS. 8 and 9 and the other pair of tines have a similar structure and operation as will be appreciated by those skilled in the art.

The second connector portion 12*b* illustratively includes a plug throat 56 (FIGS. 7–9), provided as part of the actuator 30 (FIGS. 1 and 2), and carried within the second shell 28 that moves the tines 50*b*, 51*b* from the interlocked position to the released position as the first and second connector portions 12*a*, 12*b* are moved from the mated position to the unmated position. More particularly, describing just one side of the plug throat 56 for clarity of explanation, it has a channel 62 through which the slotted body of the tine 50*b* passes.

The distal end of the tine 50*a* terminates in the form of a female catch defined by a pair of outwardly extending tabs 52. The cooperating tine 50*b* terminates in the form of a male catch defined by an enlarged head 54 with tapered leading and trailing edges 55, 59 and opposing tab-receiving notches 57 therein. A longitudinal slot 68 also extends through the enlarged head 54 to permit its squeezing during release as described further below. As will be appreciated by those skilled in the art, the tapered leading edge 55 engages the tabs 52, squeezing together the enlarged head 54 until the tabs become engaged in the notches 57. At this point the detent mechanism above can release permitting further movement of the connector portions 12*a*, 12*b* together.

To release the tines 50*a*, 50*b* the trailing edge 59 of the enlarged head 54 engages a channel 62 formed in the plug throat 56. The channel 62 is sized to pass the body of the tine and squeeze the tine as the enlarged head 54 enters the channel. As seen in FIG. 9, the enlarged head 54 is squeezed as the tine 50*b* moves relatively into the channel 62 in the direction as indicated. The tabs 52 may contact the throat plug 56 to complete separation from the male catch as will be appreciated by those skilled in the art. An important feature is that there is an outward stop against which the outward motion of the bladder seal is arrested as it is drawn into the demated position. When it hits the stop, the rearward portion or the assembly continues to be drawn forward further compressing the spring until the spring reaches another hard stop. That ensures that the seal is not left just short of its full travel before the tines 50*a*, 50*b*; 51*a*, 51*b* disengage.

The interlocking assembly may eliminate the strong springs of the prior art connectors, may ensure positive drawback not provided in the prior art connectors, and may ensure that the face-to-face sealing force between the bladder ends remains adequate during demating which was not positively provided in prior art connectors which instead had a decreasing force to the point where the ends actually separated if friction made spring-induced throat return difficult. The connector 10 may also enjoy a predetermined and constant face-to-face force of the bladder ends at all times which was also not provided in the prior art.

A method aspect of the invention is directed to making a connector 10. The method may include forming first and second bladders 14*a*, 14*b* to be positioned in respective first and second connector portions 12*a*, 12*b* and cooperating therewith so that the opposing ends 16*a*, 16*b* of the first and second bladders are urged together and moved from a closed to an open position as the first and second connector portions are moved from an unmated to a mated position. The method may further include forming the first and second connector portions 12*a*, 12*b* to be movable between the unmated and mated positions and so that at least one of the first and second connector portions defines a circular constriction 18*a*, 18*b* for closing an end 16*a*, 16*b* of a respective bladder 14*a*, 14*b* into a circular peripheral shape 20 when the first and second connector portions are in the unmated position.

Another method aspect of the invention is for making a connector 10 comprising forming first and second bladders 14*a*, 14*b* to be carried by respective first and second connector portions 12*a*, 12*b*. The method further comprises forming the interlocking assembly comprising respective first and second portions and being movable between the released position and the interlocked position as described herein.

Other features and advantages of the connector are disclosed in copending patent application Ser. No. 11/279,474 entitled "CONNECTOR INCLUDING CIRCULAR BLADDER CONSTRICTION AND ASSOCIATED METHODS", the entire contents of which are incorporated herein by reference. Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that other modifications and embodiments are intended to be included within the scope of the appended claims.

That which is claimed is:

1. A connector comprising:

first and second connector portions movable between unmated and mated positions;

first and second bladders carried by respective first and second connector portions, and each having an end movable between a closed position and an open position; and an interlocking assembly comprising first and second portions carried by respective first and second connector portions and being movable between a released position, permitting opposing ends of said first and second bladders to move apart, and an interlocked position, holding the opposing ends of said first and second bladders together as the opposing ends of said first and second bladders move from the closed position to the open position;

said interlocking assembly being moved to the interlocked position as said first and second connector portions are moved from the unmated position to the mated position, and being moved to the released position as said first and second connector portions are moved from the mated position to the unmated position.

2. A connector according to claim 1 wherein said interlocking assembly holds the opposing ends of said first and second bladders together with a substantially constant force in the interlocked position.

3. A connector according to claim 1 wherein each of said first and second connector portions comprises a base, a tubular shell extending outwardly from said base, and at least one mateable contact carried by said base within a respective bladder.

4. A connector according to claim 1 wherein said interlocking assembly comprises an initial arrestor for initially arresting movement of one of said bladders during initial engagement with an opposing end of the other of said bladders as said first and second connector portions are moved from the unmated position to the mated position.

5. A connector according to claim 4 wherein the first and second portions of said interlocking assembly respectively comprise at least one first tine and at least one second tine selectively interlocking with said at least one first tine.

6. A connector according to claim 5 wherein at least one of said first and second connector portions comprises a release feature for moving said at least one pair of first and second tines from the interlocked to the released position as said first and second connector portions are moved from the mated position to the unmated position.

7. A connector according to claim 5 wherein said initial arrestor comprises a detent mechanism coupled between said first connector portion and said at least one first tine to operate at a predetermined point along a path of travel as said first and second connector portions are moved from the unmated position to the mated position.

8. A connector according to claim 7 wherein said initial arrestor further comprises a spring operatively coupled between said first bladder and said detent mechanism for providing a desired sealing force to the opposing ends of said first and second bladders.

9. A connector according to claim 1 wherein said first and second connector portions cooperate with said first and second bladders to urge the opposing ends thereof together and to move the opposing ends from the closed position to the open position as said first and second connector portions are moved from the unmated position to the mated position.

10. A connector according to claim 9 wherein said first connector portion comprises a first tubular shell including interior portions defining a fixed frustoconical constriction; and wherein said second connector portion comprises a second tubular shell and an actuator slidable therein and defining a slidable frustoconical constriction; and wherein said second bladder extends longitudinally beyond said slidable and fixed frustoconical constrictions and into the interior of said first shell when said first and second connector portions are in the mated position so that said first and second bladders are in the open position.

11. A connector comprising:

first and second connector portions movable between mated and unmated positions;

first and second bladders carried by respective first and second connector portions, and each having an end movable between an open position and a closed position; and an interlocking assembly comprising first and second portions carried by respective first and second connector portions and being movable between an interlocked position, holding opposing ends of said first and second bladders together as the opposing ends of said first and second bladders move from the open position to the closed position, and a released position, permitting the opposing ends of said first and second bladders to move apart;

said interlocking assembly being moved to the released position as said first and second connector portions are moved from the mated position to the unmated position, and being moved to the interlocked position as said first and second connector portions are moved from the unmated position to the mated position.

12. A connector according to claim 11 wherein said interlocking assembly holds the opposing ends of said first and second bladders together with a substantially constant force in the interlocked position.

13. A connector according to claim 11 wherein each of said first and second connector portions comprises a base, a tubular shell extending outwardly from said base, and at least one mateable contact carried by said base within a respective bladder.

14. A connector according to claim 11 wherein said interlocking assembly comprises an initial arrestor for initially arresting movement of one of said bladders during initial engagement with an opposing end of the other of said bladders as said first and second connector portions are moved from the unmated position to the mated position.

15. A connector according to claim 14 wherein the first and second portions of said interlocking assembly respectively comprise at least one first tine and at least one second tine selectively interlocking with said at least one first tine.

16. A connector according to claim 15 wherein at least one of said first and second connector portions comprises a release feature for moving said at least one pair of first and second tines from the interlocked to the released position as said first and second connector portions are moved from the mated position to the unmated position.

17. A connector according to claim 15 wherein said initial arrestor comprises a detent mechanism coupled between said first connector portion and said at least one first tine to operate at a predetermined point along a path of travel as said first and second connector portions are moved from the unmated position to the mated position.

18. A connector according to claim 17 wherein said initial arrestor further comprises a spring operatively coupled between said first bladder and said detent mechanism for providing a desired sealing force to the opposing ends of said first and second bladders.

19. A connector according to claim 11 wherein said first and second connector portions cooperate with said first and second bladders to urge the opposing ends thereof together and to move the opposing ends from the closed position to the open position as said first and second connector portions are moved from the unmated position to the mated position.

20. A connector according to claim 19 wherein said first connector portion comprises a first tubular shell including interior portions defining a fixed frustoconical constriction; and wherein said second connector portion comprises a second tubular shell and an actuator slidable therein and defining a slidable frustoconical constriction; and wherein said second bladder extends longitudinally beyond said slidable and fixed frustoconical constrictions and into the interior of said first shell when said first and second connector portions are in the mated position so that said first and second bladders are in the open position.

21. A connector comprising:

first and second connector portions movable between unmated and mated positions;

first and second bladders carried by respective first and second connector portions, and each having an end movable between a closed position and an open position; and an interlocking assembly comprising first and second portions carried by respective first and second connector portions and being movable between a released position, permitting opposing ends of said first and second bladders to move apart, and an interlocked position, holding the opposing ends of said first and second bladders together as the opposing ends of said first and second bladders move from the closed position to the open position, said first and second portions of said interlocking assembly providing a positive drawback therebetween during movement from the interlocked position to the released position;

said interlocking assembly being moved to the interlocked position as said first and second connector portions are moved from the unmated position to the mated position, and being moved to the released position as said first and second connector portions are moved from the mated position to the unmated position.

22. A connector according to claim 21 wherein each of said first and second connector portions comprises a base, a tubular shell extending outwardly from said base, and at least one mateable contact carried by said base within a respective bladder.

23. A connector according to claim 21 wherein said interlocking assembly comprises an initial arrestor for initially arresting movement of one of said bladders during initial engagement with an opposing end of the other of said bladders as said first and second connector portions are moved from the unmated position to the mated position.

24. A connector according to claim 23 wherein the first and second portions of said interlocking assembly respectively comprise at least one first tine and at least one second tine selectively interlocking with said at least one first tine.

25. A connector according to claim 24 wherein at least one of said first and second connector portions comprises a release feature for moving said at least one pair of first and second tines from the interlocked to the released position as said first and second connector portions are moved from the mated position to the unmated position.

26. A connector according to claim 24 wherein said initial arrestor comprises a detent mechanism coupled between said first connector portion and said at least one first tine to operate at a predetermined point along a path of travel as said first and second connector portions are moved from the unmated position to the mated position.

27. A connector according to claim 26 wherein said initial arrestor further comprises a spring operatively coupled between said first bladder and said detent mechanism for providing a desired sealing force to the opposing ends of said first and second bladders.

28. A connector according to claim 21 wherein said first and second connector portions cooperate with said first and second bladders to urge the opposing ends thereof together and to move the opposing ends from the closed position to the open position as said first and second connector portions are moved from the unmated position to the mated position.

29. A connector according to claim 28 wherein said first connector portion comprises a first tubular shell including interior portions defining a fixed frustoconical constriction; and wherein said second connector portion comprises a second tubular shell and an actuator slidable therein and defining a slidable frustoconical constriction; and wherein said second bladder extends longitudinally beyond said slidable and fixed frustoconical constrictions and into the interior of said first shell when said first and second connector portions are in the mated position so that said first and second bladders are in the open position.

30. A connector comprising:

first and second connector portions movable between unmated and mated positions;

first and second bladders carried by respective first and second connector portions, and each having an end movable between a closed position and an open position; and at least one pair of first and second tines carried by respective first and second connector portions and being movable between a released position, permitting opposing ends of said first and second bladders to move apart, and an interlocked position, holding the opposing ends of said first and second bladders together as the opposing ends of said first and second bladders move from the closed position to the open position;

said at least one pair of first and second tines being moved to the interlocked position as said first and second connector portions are moved from the unmated position to the mated position, and being moved to the released position as said first and second connector portions are moved from the mated position to the unmated position.

31. A connector according to claim 30 wherein at least one of said first and second connector portions comprises a release feature for moving said at least one pair of first and second tines from the interlocked to the released position as said first and second connector portions are moved from the mated position to the unmated position.

32. A connector according to claim 30 wherein said first and second connector portions cooperate with said first and second bladders to urge the opposing ends thereof together and to move the opposing ends from the closed position to the open position as said first and second connector portions are moved from the unmated position to the mated position.

33. A connector according to claim 30 wherein each of said first and second connector portions comprises a base, a tubular shell extending outwardly from said base, and at least one mateable contact carried by said base within a respective bladder.

34. A connector according to claim 30 wherein said interlocking assembly comprises an initial arrestor for initially arresting movement of one of said bladders during initial engagement with an opposing end of the other of said bladders as said first and second connector portions are moved from the unmated position to the mated position.

35. A connector according to claim 34 wherein said initial arrestor comprises:

a detent mechanism coupled between said first connector portion and said at least one first tine to operate at a predetermined point along a path of travel as said first and second connector portions are moved from the unmated position to the mated position; and a spring operatively coupled between said first bladder and said detent mechanism for providing a desired sealing force to the opposing ends of said first and second bladders.

36. A method for making a connector comprising:

forming first and second connector portions movable between unmated and mated positions and carrying respective first and second bladders having ends movable between a closed position and an open position; and forming an interlocking assembly comprising first and second portions carried by respective first and second connector portions and being movable between a released position, permitting opposing ends of the first and second bladders to move apart, and an interlocked position, holding the opposing ends of the first and second bladders together as the opposing ends of the first and second bladders move from the closed position to the open position, and with the interlocking assembly being moved to the interlocked position as the first and second connector portions are moved from the unmated position to the mated position, and being moved to the released position as the first and second connector portions are moved from the mated position to the unmated position.

37. A method according to claim 36 wherein the interlocking assembly holds the opposing ends of the first and second bladders together with a substantially constant force in the interlocked position.

38. A method according to claim 36 wherein the interlocking assembly comprises an initial arrestor for initially arresting movement of one of the bladders during initial engagement with an opposing end of the other of the bladders as the first and second connector portions are moved from the unmated position to the mated position.

39. A method according to claim 36 wherein the first and second connector portions cooperate with the first and second bladders to urge the opposing ends thereof together and to move the opposing ends from the closed position to the open position as the first and second connector portions are moved from the unmated position to the mated position.

40. A method according to claim 36 wherein each of the first and second connector portions comprises a base, a tubular shell extending outwardly from the baser and at least one mateable contact carried by the base within a respective bladder.

41. A method according to claim 36 wherein the first and second portions of the interlocking assembly respectively comprise at least one first tine and at least one second tine selectively interlocking with the at least one first tine.

42. A method according to claim 41 wherein at least one of the first and second connector portions comprises a release feature for moving the at least one pair of first and second tines from the interlocked to the released position as the first and second connector portions are moved from the mated position to the unmated position.

43. A method for making a connector comprising:

forming first and second connector portions movable between unmated and mated positions and carrying respective first and second bladders having ends movable between a closed position and an open position; and forming an interlocking assembly comprising first and second portions carried by respective first and second connector portions and being movable between a released position, permitting opposing ends of the first and second bladders to move apart, and an interlocked position holding the opposing ends of the first and second bladders together as the opposing ends of the first and second bladders move from the closed position to the open position, with the first and second portions of the interlocking assembly providing a positive drawback therebetween during movement from the interlocked position to the released position, and with the interlocking assembly being moved to the interlocked position as the first and second connector portions are moved from the unmated position to the mated position, and being moved to the released position as the first and second connector portions are moved from the mated position to the unmated position.

44. A method according to claim 43 wherein the interlocking assembly comprises an initial arrestor for initially arresting movement of one of the bladders during initial engagement with an opposing end of the other of the bladders as the first and second connector portions are moved from the unmated position to the mated position.

45. A method according to claim 43 wherein the first and second connector portions cooperate with the first and second bladders to urge the opposing ends thereof together and to move the opposing ends from the closed position to the open position as the first and second connector portions are moved from the unmated position to the mated position.

46. A method according to claim 43 wherein each of the first and second connector portions comprises a baser a tubular shell extending outwardly from the base, and at least one mateable contact carried by the base within a respective bladder.

47. A method according to claim 43 wherein the first and second portions of the interlocking assembly respectively comprise at least one first tine and at least one second tine selectively interlocking with the at least one first tine.

48. A method according to claim 47 wherein at least one of the first and second connector portions comprises a release feature for moving the at least one pair of first and second tines from the interlocked to the released position as the first and second connector portions are moved from the mated position to the unmated position.

* * * * *